US007595710B2

(12) United States Patent
DeBoer et al.

(10) Patent No.: US 7,595,710 B2
(45) Date of Patent: Sep. 29, 2009

(54) MAGLATCH MECHANISM FOR USE IN LIGHTING CONTROL POD

(75) Inventors: John DeBoer, Decatur, GA (US); Brian Timothy McCoy, Lawrenceville, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 183 days.

(21) Appl. No.: 11/823,523

(22) Filed: Jun. 27, 2007

(65) Prior Publication Data

US 2008/0012664 A1 Jan. 17, 2008

Related U.S. Application Data

(60) Provisional application No. 60/830,535, filed on Jul. 13, 2006.

(51) Int. Cl.
*H01H 75/00* (2006.01)
*H01H 9/20* (2006.01)

(52) U.S. Cl. ..... 335/6; 335/14; 335/167; 335/170; 335/171; 335/174; 335/177; 335/179; 335/181

(58) Field of Classification Search ..... 335/6, 335/14, 167–184
See application file for complete search history.

(56) References Cited

U.S. PATENT DOCUMENTS

| | | | | |
|---|---|---|---|---|
| 4,816,792 | A | 3/1989 | Belbel et al. | |
| 6,310,753 | B1 | 10/2001 | Dollar et al. | |
| 6,507,255 | B1 * | 1/2003 | Ennis et al. | 335/6 |
| 6,531,938 | B1 | 3/2003 | Smith et al. | |
| 6,791,442 | B1 | 9/2004 | Schmidt | |
| 6,812,815 | B2 * | 11/2004 | Simms et al. | 335/6 |
| 2005/0162245 | A1 * | 7/2005 | Zhou et al. | 335/106 |

FOREIGN PATENT DOCUMENTS

EP 0345412 A2 12/1989

* cited by examiner

*Primary Examiner*—Ramon M Barrera
(74) *Attorney, Agent, or Firm*—Jose de la Rosa

(57) ABSTRACT

An electrical contact assembly includes a magnetic latch solenoid for actuating a moveable contact of a contact pair. The magnetic latch solenoid includes a magnet that latches the contact assembly in an open position, and a coil that moves an armature to the latched position under current in one polarity, and disrupts the permanent magnet field to release the armature from the latched position under current in a reverse polarity. A spring biases the contacts to the closed position. The spring is separate from the magnetic latch solenoid. The contact assembly may also include a printed circuit board for providing pulses to the coil to operate the assembly. The contact assembly is part of a remote operated circuit breaker assembly.

9 Claims, 5 Drawing Sheets

MAGLATCH MECHANISM FOR USE IN LIGHTING CONTROL POD

CROSS REFERENCE TO RELATED APPLICATIONS

This application claims the benefit of priority from U.S. Provisional Patent Application Ser. No. 60/830,535 entitled "Maglatch Mechanism for Use in Lighting Control Pod," filed on Jul. 13, 2006, the contents of which are hereby incorporated by reference herein in their entirety.

FIELD OF THE INVENTION

The present invention relates generally to an improved remote controlled circuit breaker and circuit control assembly, and more specifically to remote controlled contacts having a magnetic latch mechanism providing a bi-stable operation.

BACKGROUND OF THE INVENTION

There has been an increasing demand for remotely controllable circuit breaker assemblies that can reciprocate between an open circuit and a closed circuit in response to a remotely generated command. One advantageous application for such circuit breaker assemblies is in control panelboards that are used for automated control systems such as building management systems. Building management systems may include automated lighting systems, HVAC control systems, fire control, security, and control of refrigerator/freezer systems. Automated lighting systems have been developed for the control of lighting circuits based upon inputs such as the time-of-day, wall switches, occupancy sensors and/or control from a power distribution system. Lighting control systems offer an opportunity to save energy by automating the process of cutting back on the number of lighting fixtures that are illuminated, automatically turning off lighting fixtures when they are not required, or by cutting out artificial lighting altogether when circumstances warrant. For example, ambient light sensors can be used to control lighting circuits in response to ambient light levels. The sensors can serve both switching and automatic dimming functions that can adjust the output of the lighting system continually in response to the amount of daylight striking the ambient light sensor. Occupancy sensors can be used to activate lighting when someone is in a space and to deactivate the lighting, perhaps after a set time interval, when a person is no longer detected in the space.

In general, circuit breaker assemblies that can be remotely controlled may be divided into at least two classes. The first is the remote-operated circuit breaker. In a remote-operated circuit breaker, two pairs of contacts are located within a single package. The first (or primary) pair of contacts is used to interrupt short circuits, to interrupt overloads, and to switch the circuit breaker on and off via a handle. The second pair of contacts in a remote operated circuit breaker may be used, for example, in a lighting control application. In some applications, a single pair of contacts serves both functions.

Another class of remotely controlled circuit breaker assemblies is an assembly that includes a circuit control pod, or lighting control pod. In such an assembly, a separate relay device or "pod," including a mechanism to operate a pair of contacts remotely, is attached to a standard circuit breaker that does not have a means of remote operation. The circuit control pod adds an additional pair of contacts in series with the circuit breaker.

Several types of mechanisms have been used to remotely operate the contact pair in a circuit control pod. Those include a bi-directional solenoid with an over-center spring, a worm-gear actuated DC motor system, and a multi-linkage solenoid driven mechanism.

In the over center design, a solenoid must be sized to work against a non-linear spring force. The solenoid must furthermore have two coils to operate bi-directionally. Those factors can increase the size of the required mechanism.

The worm-gear motor design produces a loud noise due to the operation of the DC motor. The worm-gear design is furthermore prone to slippage and failure of the mechanism. Also, when applied in arrays such as those found in standard panel boards having 42 devices, issues such as motor in-rush and under-voltage conditions in the power line must be overcome by increasing the size and complexity of power supplies or the power management system.

The multi-linkage solenoid driven mechanism has the disadvantage of requiring several points of rotation, and numerous moving parts. In typical applications, multiple springs are required. Given that a lighting control device is expected to cycle 50,000-100,000 times during its life, the use of multi-spring assemblies increases the risk that frictional wear will cause the mechanism to fail during its intended life.

U.S. Pat. No. 4,816,792 to Belbel et al. describes a main circuit breaker contact that may be remotely operated by an electromagnet. The design incorporates a permanent magnet for holding an armature in position. The permanent magnet mechanism operates directly on the circuit breaker contacts. Such a design increases the mass of the circuit breaker mechanism and thus results in parasitic loading of the breaker mechanism, degrading performance.

U.S. Pat. No. 6,531,938 to Smith et al. teaches a remote operated circuit breaker assembly having a remote module for remotely operating the circuit breaker. A motor disposed in the module housing operates the breaker switch remotely. The mechanism requires actual operation of the handle of the breaker. Because the breaker handle requires greater force, the actuating device must be a larger and higher-cost unit.

There is presently a need for an improved design and method for opening and closing remote controlled contacts. Such a design should have a low cost and should be of high reliability. Such a design should furthermore be compact for use in a small package area. To the inventors' knowledge, no such design is currently available.

SUMMARY OF THE INVENTION

One embodiment of the present invention is a contact assembly for reciprocating between a stable closed position to allow current flow through the contact assembly and a stable open position to prevent current flow through the contact assembly. The assembly includes a base, a fixed contact mounted to the base, a contact arm, and a pivot pin for pivotably mounting the contact arm to the base. A moveable contact is mounted on the contact arm for movement between the stable closed position wherein the moveable contact is in contact with the fixed contact, and the stable open position wherein the moveable contact is spaced apart from the fixed contact. A spring exerts a spring force on the contact arm to bias the moveable contact toward the stable closed position of the contact assembly.

The contact assembly also includes a magnetic latch solenoid comprising a magnetic armature and a permanent magnet in proximity to the armature when the armature is in a retracted position. The permanent magnet has a magnetic field exerting a latching force on the armature to maintain the armature in the retracted position. The magnetic latch solenoid also includes a coil in proximity with the armature, the coil being adapted to exert a retracting force on the armature in excess of the spring force in a direction of the retracted position of the armature when electrical energy is applied to the coil in a first polarity, and to disrupt the magnetic field when electrical energy is applied to the coil in a second polarity to release the armature from the retracted position.

A wrist pin connects the contact arm and the armature, the wrist pin being disposed in a clearance hole in at least one of the contact arm and the armature, permitting relative movement thereof. The retracted position of the armature results in the stable open position of the contact assembly.

The spring may be separate from the magnetic latch solenoid.

The contact assembly may also include a line terminal for connection with an electrical source of the current flow, and a braided wire connector electrically connecting the line terminal and the contact arm.

The contact arm may further comprise a mechanical spring interface, the spring exerting the spring force between the mechanical spring interface and a base of the contact assembly. The mechanical spring interface may be remote from the moveable contact on the contact arm.

The contact assembly may also include a load terminal electrically connected to the fixed contact for connecting a current load to the contact assembly.

The assembly may comprise a printed circuit board connected to the coil for applying a pulse of electrical energy to the coil in the first polarity to open the contacts and for applying a pulse of electrical energy to the coil in the second polarity to close the contacts. The pulses of electrical energy may be pulse-width-controlled DC signals.

Another embodiment of the invention is a method for remotely operating a contact assembly between a stable closed position to allow current flow from a line to a load through the contact assembly and a stable open position to prevent current flow through the contact assembly. The method includes the steps of providing a fixed contact connected to a load side of a circuit breaker, the breaker being set to open the circuit between the line and the load at or above a predetermined current load; providing a moveable contact adapted for movement between the stable closed position wherein the moveable contact is in contact with the fixed contact and the stable open position wherein the moveable contact is spaced apart from the fixed contact; providing a spring exerting a spring force on the moveable contact toward the stable closed position; providing a magnetic latch solenoid including a magnetic armature connected to the moveable contact for movement therewith; a permanent magnet in proximity to the armature when the moveable contact is in the stable open position, the permanent magnet having a magnetic field exerting a latching force on the armature to maintain the armature and moveable contact in the stable open position; and a coil in proximity with the armature; applying electrical energy to the coil in a first polarity to exert an opening force on the armature in excess of the spring force to move the armature and moveable contact to be held in the stable open position by the latching force of the magnetic field; and applying electrical energy to the coil in a second polarity to disrupt the magnetic field and release the armature and moveable contact from the stable open position to be displaced by the spring to the stable closed position.

The steps of applying electrical energy to the coil may further comprise applying electrical pulses to the coil. The pulses of electrical energy may be pulse-width-controlled DC signals. The electrical energy may be approximately 1.7 amps at 24 volts DC. The steps of applying electrical energy to the coil may include applying at least one pulse having a duration of less than 50 milliseconds. The step of applying electrical energy to the coil in the second polarity may comprise applying a pulse having a duration of less than 10 milliseconds.

Yet another embodiment of the invention is a circuit breaker assembly positionable in a circuit between a line and a load. The circuit breaker assembly comprises a circuit breaker set to open the circuit between the line and the load at or above a predetermined current load; and a contact assembly adapted for reciprocating between a stable closed position to allow current flow through the contact assembly and a stable open position to prevent current flow through the contact assembly.

The contact assembly comprises a fixed contact connected to the load side of the circuit breaker; a moveable contact electrically connected to a load side conductor for connection to a load, the moveable contact being moveable between the stable closed position wherein the moveable contact is in contact with the fixed contact, and the stable open position wherein the moveable contact is spaced apart from the fixed contact; a spring exerting a spring force on the moveable contact and biasing the moveable contact toward the stable closed position; and a magnetic latch solenoid. The magnetic latch solenoid comprises a magnetic armature connected to the moveable contact for movement therewith; a permanent magnet in proximity to the armature when the moveable contact is in the stable open position, the permanent magnet having a magnetic field exerting a latching force on the armature to maintain the armature and moveable contact in the stable open position; and a coil in proximity with the armature, the coil being adapted to exert an opening force on the armature in excess of the spring force in a direction of the stable open position when electrical energy is applied to the coil in a first polarity, and to disrupt the magnetic field when electrical energy is applied to the coil in a second polarity to release the armature and moveable contact from the stable open position.

The spring may be separate from the magnetic latch solenoid. The contact assembly may further comprise a contact arm having a first end pivotably mounted to a base of the contact assembly, the moveable contact being mounted on a second end of the contact arm.

The contact assembly may also include a wrist pin connecting the armature and the contact arm, the wrist pin being disposed in at least one clearance hole permitting relative movement of the armature and the contact arm. A braided wire connector may electrically connect the load side conductor and the contact arm. The contact arm may also comprise a mechanical spring interface, the spring exerting the spring force between the mechanical spring interface and a base of the contact assembly. The mechanical spring interface may be remote from the moveable contact on the contact arm.

The contact assembly may also comprise a printed circuit board connected to the coil for applying a pulse of electrical energy to the coil in the first polarity to open the contacts and for applying a pulse of electrical energy to the coil in the second polarity to close the contacts. The pulses of electrical energy may be pulse-width-controlled DC signals.

DESCRIPTION OF THE INVENTION

The present invention is a method and apparatus for opening and closing a pair of contacts in a circuit control pod such as a lighting control pod. A magnetic latch solenoid mechanism, or "maglatch," is employed with a spring that is not located in close proximity to the contacts or to the maglatch in order to provide bi-stable operation.

Figure 1A:
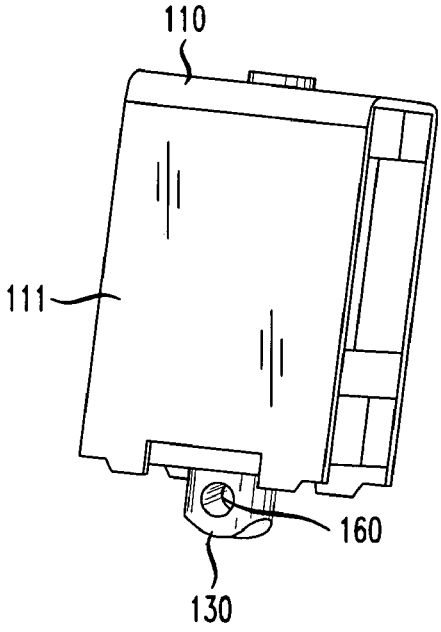
FIGS. 1A and 1B are perspective views of a magnetic latch solenoid in extended and retracted positions, respectively, in accordance with the invention.
Figure 1B:
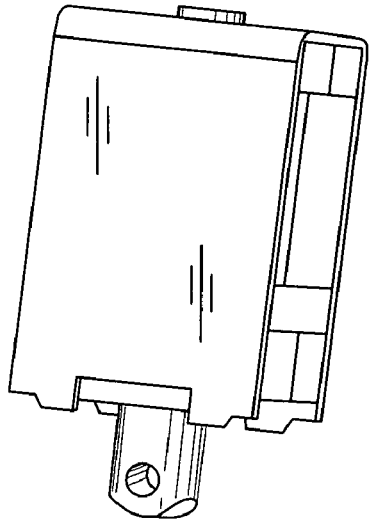

A maglatch is a variation of a solenoid in which a permanent magnet is added to a solenoid. This component allows for translation of electrical signals to a mechanical motion. A maglatch used in a preferred embodiment of the present invention is shown in FIGS. 1A and 1B. The maglatch includes a maglatch housing 110 and a plunger 160. The plunger 160 may have a wrist pin hole 130 for accepting a wrist pin as described in more detail below.

Figure 2:
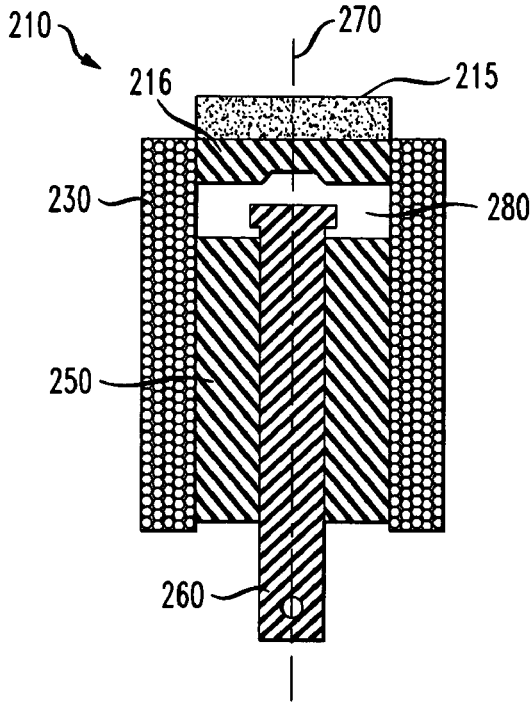
FIG. 2 is a diagrammatic cross sectional view of a magnetic latch solenoid in accordance with the invention.

A schematic cross sectional view of a maglatch 210 in accordance with the invention is shown in FIG. 2. A plunger 260 extends from the maglatch 210 and corresponds to the plunger 160 of FIG. 1A. Other element numbers incremented by multiples of 100 in other figures represent similar elements. A stationary magnetic core 250 surrounds the plunger. The magnetic core may be made of a soft ferrous material that responds to magnetic fields. The plunger 260 is mounted for reciprocating movement in the maglatch, using bushings or other means (not shown) as known in the art.

The maglatch 210 further comprises electromagnetic coil 230 connected to a housing of the maglatch (housing 111 of FIG. 1A). The coil 230 induces a magnetic field in the core 250 when current is passed through the coil. The magnetic field exerts a force on the armature 250 in an axial direction; i.e., along an axis 270 of the maglatch 210. When an electrical potential is placed across the coil in first polarity, magnetic force on the armature urges the armature in an upward direction as oriented in FIG. 2, retracting the plunger into the maglatch.

The maglatch 210 further comprises a permanent magnet 215 and may include a flux guide 216. When the plunger 260 is in a retracted position and therefore proximate the permanent magnet 215 and flux plate 216, a strong magnetic circuit is formed through those members, exerting an attractive force on the plunger 260 and "latching" it in the retracted position.

The effect of the permanent magnet 215 depends upon the position of the plunger 260. When the plunger is extended, the magnet provides no function because the air gap 280 in the magnetic circuit is sufficiently large to greatly weaken the field. When the solenoid is pulsed with current in the first polarity, electromagnetic forces on the plunger 260 pull it inward. Once the plunger is retracted, the permanent magnet 215 of the maglatch holds the plunger in place. That holding force creates one of the two stable positions of the switching mechanism of the invention. The holding force is directly dependant upon the strength of the maglatch permanent magnet. The solenoid portion of the maglatch creates the force that allows the plunger to move from the extended position to the retracted position.

Figure 3:
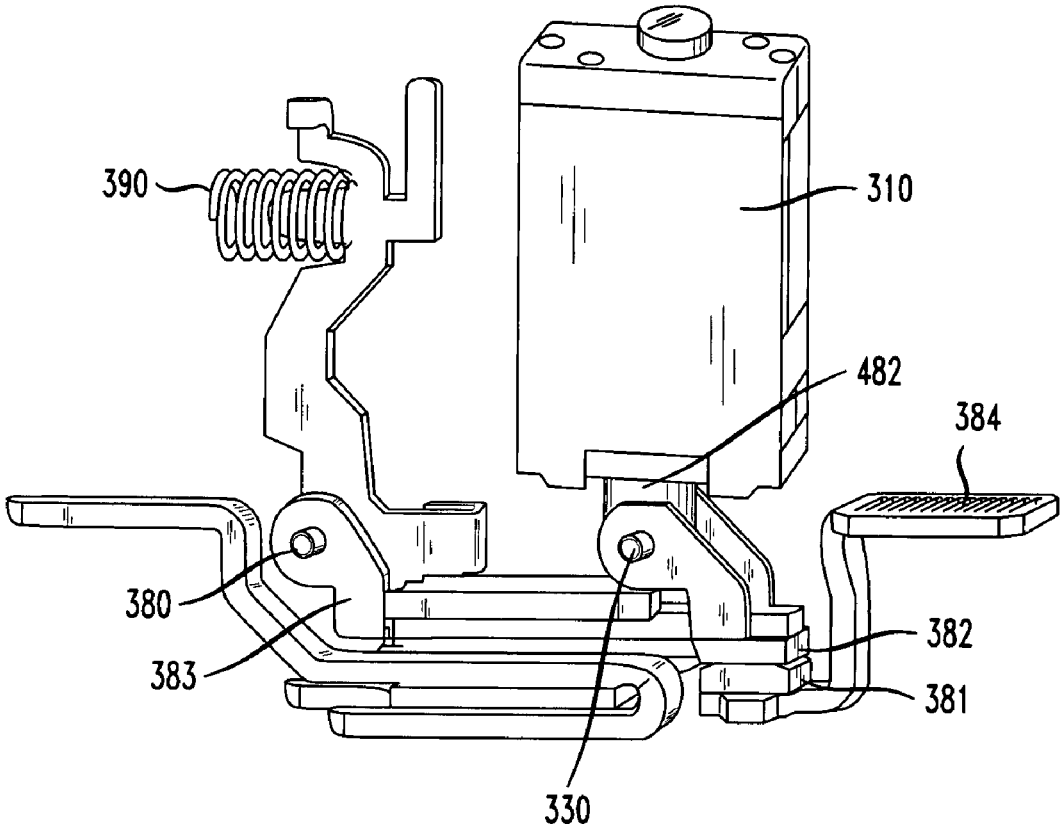
FIG. 3 is a perspective view of a partial electrical contact assembly in accordance with an embodiment of the invention.

In order to provide motion in the other direction, i.e., to extend the plunger, the switching mechanism also requires a spring 390, shown in FIG. 3. The spring 390 is mounted externally to the maglatch mechanism 310, and acts on an L-shaped contact arm 383, pivotably mounted to a base by a pivot pin 380. A moveable contact 382 is mounted on the contact arm 383 by welding or another method. In the closed position shown in FIG. 3, the moveable contact 382 is in contact with a fixed contact 381. The spring 390 is preferably a compression spring that places a continuous force on the contact arm 383 to extend the plunger 360. When the plunger is retracted, the spring force on the plunger 360 is lower than the force on the plunger of the permanent magnet, maintaining the plunger in the stable retracted position.

Returning to FIG. 2, when a brief DC pulse is provided to the maglatch 210 by applying a potential to the coil 230 in a second polarity, the electromagnetic field of the coil temporarily disables the permanent magnet 215 by interfering with the magnetic circuit containing the plunger 260. That allows the spring to move the plunger 260 outward until the plunger is fully extended. In the extended position, the spring holds the plunger in its second stable position, with the contacts 381, 382 in contact.

Figure 4A:
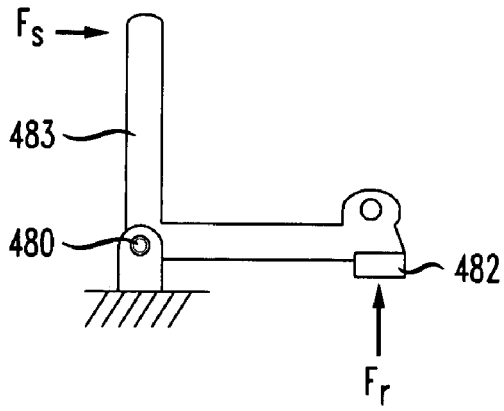
FIGS. 4A-4D are simplified force diagrams showing a contact arm and moveable contact in accordance with the invention.

The contact assembly of the present invention has two stable equilibrium positions: contacts closed and contacts open. Those positions will now be described with reference to FIGS. 4A-4D. In the "contacts closed" position shown in FIG. 4A, the force of the spring ($F_s$) on the contact arm 483 creates a torque about the pivot pin 480, biasing the moveable contact 482 against the fixed contact (not shown), which acts as a mechanical stop. The spring force therefore holds the contacts closed. A reaction force ($F_r$) on the moveable contact 482 creates a corresponding torque on the contact arm 483, maintaining equilibrium. The maglatch does not affect the mechanism.

Figure 4B:
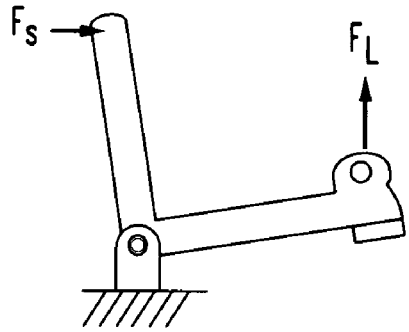

FIG. 4B shows the contact arm in the stable "contacts opened" position of the contact assembly. The permanent magnet in the maglatch applies a continuous force $F_L$ to the device. The force $F_L$ is greater than the force $F_s$ exerted by the spring. A mechanical stop (not shown) applies a reaction force and prevents further counterclockwise rotation of the arm.

Figure 4C:
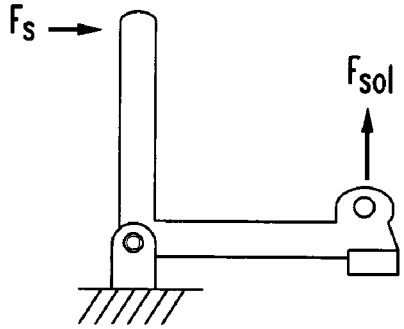

The force diagram of FIG. 4C shows the contact arm in a non-equilibrium state, resulting in motion from the "contacts closed" position to the "contacts open" position. To start that motion, a force $F_{sol}$ is generated by the solenoid acting on the armature of the maglatch, placing a torque on the contact arm that exceeds the torque from the spring force $F_s$. The contacts are thereby moved apart as the plunger retracts into the maglatch, until the permanent magnet in the maglatch latches the plunger in the retracted position.

Figure 4D:
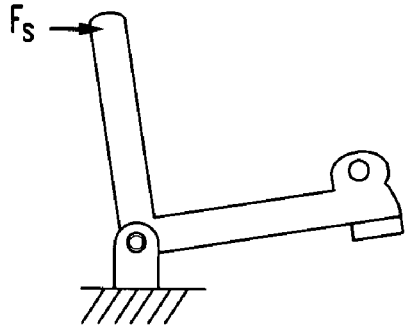

The force diagram of FIG. 4D illustrates motion of the contact assembly of the invention from the "contacts open" position to the "contacts closed" position. A DC pulse applied across the maglatch solenoid temporarily disables $F_L$ by interfering with the magnetic field of the permanent magnet. As a result, the spring force $F_s$ rotates the contact arm clockwise until the contacts are closed, providing a mechanical stop.

Figure 5:
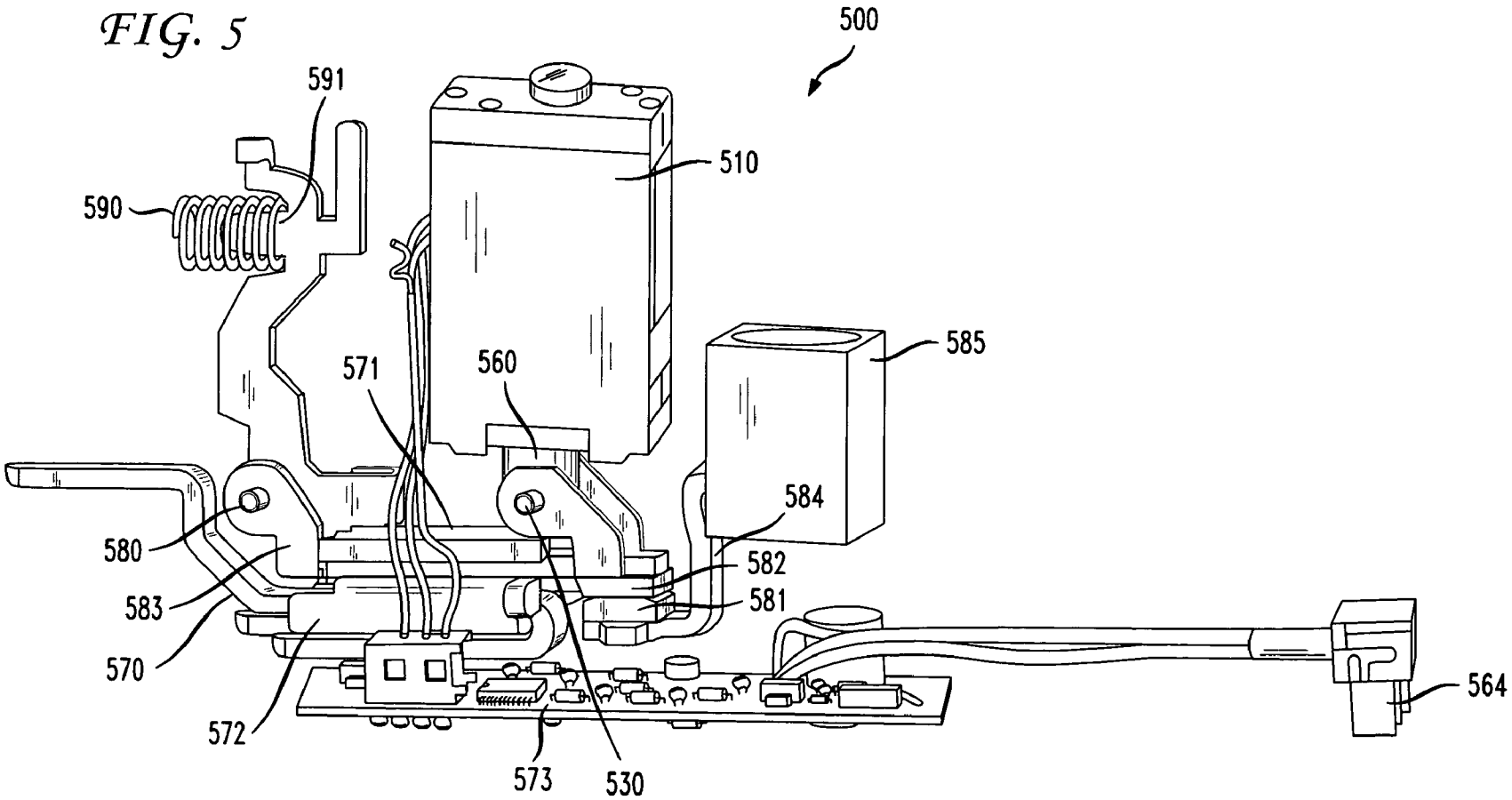
FIG. 5 is a perspective view of an electrical contact assembly including a printed circuit board and several associated components, in accordance with an embodiment of the invention.

A preferred embodiment of the circuit control pod 500 of the invention, including its major components, is described below with reference to FIG. 5.

The spring 590 is a compression spring located away from the contacts 581, 582 to reduce the spring's exposure to heat generated by opening and closing the contacts. The spring is captured directly by the base and cover (not shown) of the circuit control pod 500, and acts on the L-shaped contact arm 583.

The contact arm 583 serves several functions. The arm provides a conductor for current flow to the moveable contact 582. Line current flows from a line side terminal 570 through a braided wire conductor (not shown) that is welded to the contact arm in the region near the pivot pin 580. The line current then flows from the braid weld site through the arm to the moveable contact 582. The moveable contact is also welded to the contact arm. Other connection techniques, such as soldering and brazing, may alternatively be used to attach the braid and the moveable contact to the contact arm.

The contact arm 583 pivots about the pivot pin 580 to provide the motion to open and close the electrical contacts 581, 582. The arm 583 further provides a mechanical interface 591 with spring 590. The arm provides mechanical support for both the pivot pin 580 and the wrist pin 530.

In one embodiment of the invention, the contact arm 583 provides mechanical support for an armature 571 used in a "blow closed" mechanism that also includes a magnetic yoke 572 mounted in proximity to the line side conductor 570 and the contact arm 583. The "blow closed" mechanism operates when excess current flows through the contact arm 583 and the line side conductor 570, inducing a magnetic field in the yoke 572, which exerts an attractive force on the armature 571. That attractive force holds the contacts closed and resists forces at the contacts that otherwise tend to blow the contacts apart under high current loads.

The contact arm 583 serves as one of a pair of parallel conductors that additionally holds the contacts 581, 582 together under over-current conditions. Current flowing in parallel paths in opposing surfaces of the contact arm 583 and the line side conductor 570 exert attractive forces between those two components. Those attractive forces, in addition to the force of the spring 590 and the above-described "blow-closed" mechanism, hold the contacts closed during an over-current condition. The parallel conductors and the "blow-closed" mechanism are described in more detail in the commonly assigned patent application entitled "Design and Method for Keeping Electrical Contacts Closed During Short Circuits," filed concurrently with the present application, the contents of which are hereby incorporated by reference herein in their entirety.

The contact arm 583 may also serve as part of a visual flag indicator (not shown) and as part of an auxiliary contact mechanism (not shown). Further, if the angle of the spring is changed, and the contact arm 583 is slotted to permit translation relative to the pivot pin 580, the contact arm may be adapted to allow sliding motion between contacts to break tack welds that may result from arcing.

The pivot pin 580 provides for smooth rotation of the contact arm 583. The pin is captured in the base 675 (FIG. 6) and cover (not shown) of the lighting control pod. The pin may be made of hardened steel for additional endurance of the pivot joint. The pivot pin connection provides long life to the joint as compared to known contact arm joints.

The contact pair includes a moveable contact 582 and a fixed contact 581. The contacts make and break the electrical load. The moveable contact 582 is welded directly to the contact arm 583. The fixed contact 581 is welded to the load terminal 584.

The load terminal 584 provides an electrical connection from the contact 581 to the outside of the circuit control pod. The other end of the load terminal interfaces with a lug 585 for the securing of an external conductor (wire, electrical bus, etc.) to the circuit control pod. Features of the load terminal allow for a robust mechanical and electrical connection.

A wrist pin 530 is provided to allow for differences between the linear motion of the maglatch plunger 560 and the rotational motion of the contact arm 583. For the limited rotational motion of the preferred design relative to the length of the arm, a small amount of clearance is provided in the hole diameter where the wrist pin 530 engages the contact arm 583.

The printed circuit board 573 provides internal control of the circuit control pod. The printed circuit board receives power through an external connector 574. The printed circuit board 573 switches the polarity and duration of energy supplied to the maglatch 510 so that no additional devices (diode bridge, etc.) are required to operate the maglatch.

In a preferred embodiment, the circuit control pod is part of a larger system called an Integrated Lighting Control System. In the Integrated Lighting Control System, a set of many circuit control pods is connected to a computer via a communications bus. Signals to open or close the circuit control pod contacts are sent by the computer down the communication bus. When the signal reaches a circuit control pod, the circuit control pod electronics identify that the signal is intended for a particular circuit control pod. One technique for identifying a particular circuit control pod on a communications bus is disclosed in U.S. Patent Publication No. 20070064360, published Mar. 22, 2007 and entitled "Selection Line and Serial Control of Remote Operated Devices in an Integrated Power Distribution System," the contents of which are incorporated by reference herein in their entirety.

Once the signal is decoded, the circuit control pod printed circuit board 573 issues a positive DC, pulse-width-controlled signal of 18-50 milliseconds in duration to the maglatch 510. The printed circuit board 573 must properly regulate the pulse width and polarity in order to retract the maglatch plunger 560. When the opposite motion is desired, the circuit control pod electronics board 573 delivers a negative DC pulse for 2-6 milliseconds. That second pulse temporarily disrupts the field of the permanent magnet within the maglatch 510, allowing the plunger 560 to extend.

Figure 6A:
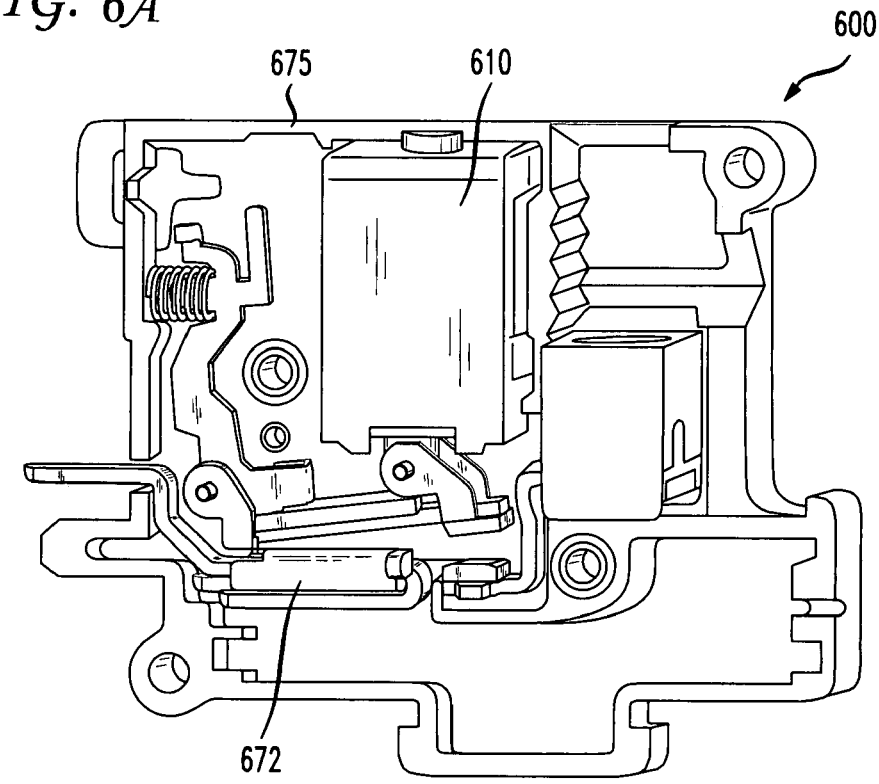
FIGS. 6A and 6B are perspective views of an electrical contact assembly in open and closed positions, in accordance with an embodiment of the invention.
Figure 6B:
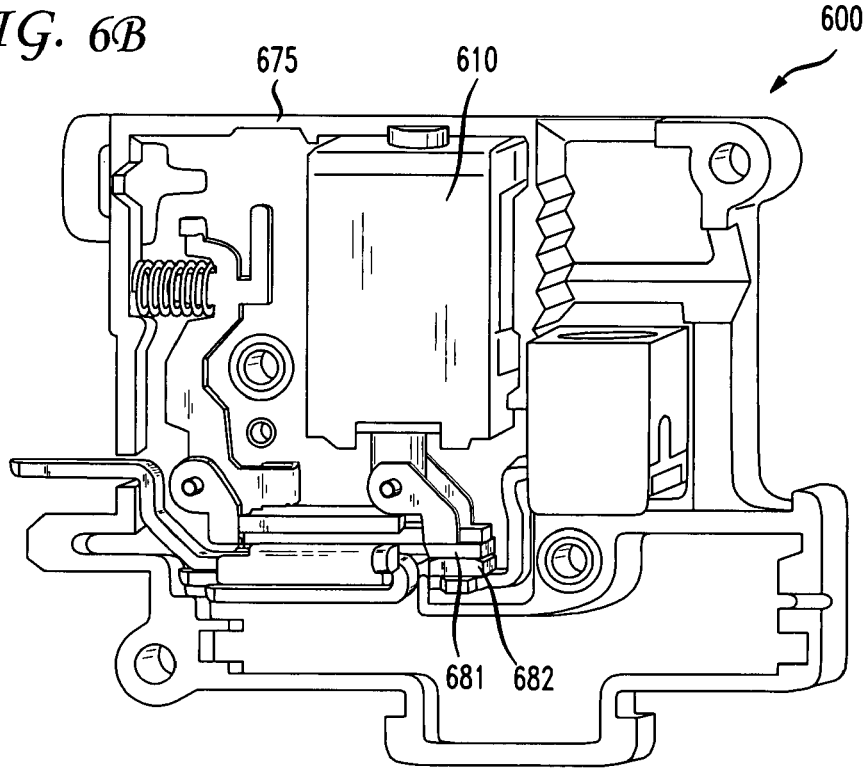

A maglatch circuit control pod 600 of the present invention is shown in FIGS. 6A and 6B as mounted in a base 675. The base may be made from a heat-tolerant insulating material such as a high-temperature thermoplastic or a thermoset resin. The pod 600 is shown in an open position in FIG. 6A, with the maglatch 610 retracted. The pod 600 is shown in a closed position in FIG. 6B with the maglatch 610 extended and the contacts 682, 681 closed.

The maglatch circuit control pod of the present invention has numerous advantages over existing switching devices. As compared to a worm-gear motor design, the device is quiet; the only noise produced being the sound of contacts striking. The device furthermore runs on very low power. For example, a preferred embodiment of the invention requires only about 1.7 A at 24 VDC for 2-25 milliseconds.

Operation of maglatch circuit control pod of the present invention is rapid. The inventors have measured response times for a device according to the invention at less than 4.5 milliseconds to break continuity.

The device of the invention is compact in part because it does not require a large armature for mechanical advantage. Because the device does not also manage or conflict with circuit breaker functions, it is simplified electrically and mechanically, and does not require compromises on contact design.

Due in part to the pivot pin and wrist pin designs, the system has a longer mechanical life. The expected life of a contact assembly according to one embodiment of the invention is in excess of 450,000 cycles.

The foregoing detailed description is to be understood as being in every respect illustrative and exemplary, but not restrictive, and the scope of the invention disclosed herein is not to be determined from the description of the invention, but rather from the claims as interpreted according to the full breadth permitted by the patent laws. For example, while the contact arm is described herein as having a particular L-shaped configuration, other contact arm designs may be substituted. It is to be understood that the embodiments shown and described herein are only illustrative of the principles of the present invention and that various modifications may be implemented by those skilled in the art without departing from the scope and spirit of the invention.

What is claimed is:

1. A contact assembly for reciprocating between a stable closed position to allow current flow through the contact assembly and a stable open position to prevent current flow through the contact assembly, the assembly comprising:

a base;

a fixed contact mounted to the base;

a contact arm;

a pivot pin for pivotably mounting the contact arm to the base;

a moveable contact mounted on the contact arm for movement between the stable closed position wherein the moveable contact is in contact with the fixed contact, and the stable open position wherein the moveable contact is spaced apart from the fixed contact;

a spring exerting a spring force on the contact arm to bias the moveable contact toward the stable closed position of the contact assembly;

a magnetic latch solenoid comprising:

a magnetic armature;

a permanent magnet in proximity to the armature when the armature is in a retracted position, the permanent magnet having a magnetic field exerting a latching force on the armature to maintain the armature in the retracted position; and a coil in proximity with the armature, the coil being adapted to exert a retracting force on the armature in excess of the spring force in a direction of the retracted position of the armature when electrical energy is applied to the coil in a first polarity, and to disrupt the magnetic field when electrical energy is applied to the coil in a second polarity to release the armature from the retracted position; and a wrist pin connecting the contact arm and the armature, the wrist pin being disposed in a clearance hole in at least one of the contact arm and the armature, permitting relative movement thereof;

the retracted position of the armature resulting in the stable open position of the contact assembly.

2. The contact assembly of claim 1, wherein the spring is separate from the magnetic latch solenoid.

3. The contact assembly of claim 1, further comprising:

a line terminal for connection with an electrical source of the current flow; and a braided wire connector electrically connecting the line terminal and the contact arm.

4. The contact assembly of claim 1, wherein the contact arm further comprises:

a mechanical spring interface, the spring exerting the spring force between the mechanical spring interface and a base of the contact assembly.

5. The contact assembly of claim 4, wherein the mechanical spring interface is remote from the moveable contact on the contact arm.

6. The contact assembly of claim 1, further comprising:

a load terminal electrically connected to the fixed contact for connecting a current load to the contact assembly.

7. The contact assembly of claim 1, further comprising:

a printed circuit board connected to the coil for applying a pulse of electrical energy to the coil in the first polarity to open the contacts arid for applying a pulse of electrical energy to the coil in the second polarity to close the contacts.

8. The contact assembly of claim 7, wherein the pulses of electrical energy are pulse-width-controlled DC signals.

9. A circuit breaker assembly positionable in a circuit between a line and a load, the assembly comprising:

a circuit breaker set to open the circuit between the line and the load at or above a predetermined current load; and a contact assembly adapted for reciprocating between a stable closed position to allow current flow through the contact assembly and a stable open position to prevent current flow through the contact assembly, the assembly comprising a fixed contact connected to the load side of the circuit breaker;

a moveable contact electrically connected to a load side conductor for connection to a load, the moveable contact being moveable between the stable closed position wherein the moveable contact is in contact with the fixed contact and the stable open position wherein the moveable contact is spaced apart from the fixed contact;

a spring exerting a spring force on the moveable contact and biasing the moveable contact toward the stable closed position;

a magnetic latch solenoid comprising:

a magnetic armature connected to the moveable contact for movement therewith;

a permanent magnet in proximity to the armature when the moveable contact is in the stable open position, the permanent magnet having a magnetic field exerting a latching force on the armature to maintain the armature and moveable contact in the stable open position; and a coil in proximity with the armature, the coil being adapted to exert an opening force on the armature in excess of the spring force in a direction of the stable open position when electrical energy is applied to the coil in a first polarity, and to disrupt the magnetic field when electrical energy is applied to the coil in a second polarity to release the armature and moveable contact from the stable open position;

a contact arm having a first end pivotably mounted to a base of the contact assembly, the moveable contact being mounted on a second end of the contact arm; and a wrist pin connecting the armature and the contact arm, the wrist pin being disposed in at least one clearance hole permitting relative movement of the armature and the contact arm.

* * * * *